US009679693B2

(12) United States Patent
Askeland et al.

(10) Patent No.: US 9,679,693 B2
(45) Date of Patent: Jun. 13, 2017

(54) SUBSEA TRANSFORMER WITH SEAWATER HIGH RESISTANCE GROUND

(71) Applicant: ONESUBSEA IP UK LIMITED, London (GB)

(72) Inventors: Audun Magne Askeland, Bergen (NO); Asbjoern Diesen, Bergen (NO); Aage Hadler-Jacobsen, Nesttun (NO)

(73) Assignee: OneSubsea IP UK Limited, London (GB)

( * ) Notice: Subject to any disclaimer, the term of this patent is extended or adjusted under 35 U.S.C. 154(b) by 285 days.

(21) Appl. No.: 14/631,661

(22) Filed: Feb. 25, 2015

(65) Prior Publication Data

US 2016/0247628 A1 Aug. 25, 2016

(51) Int. Cl.

| | |
|---|---|
| ***H01F 27/10*** | (2006.01) |
| ***H01F 30/12*** | (2006.01) |
| ***H01F 27/08*** | (2006.01) |
| ***H01F 27/29*** | (2006.01) |
| ***E02B 3/00*** | (2006.01) |
| ***H01F 27/02*** | (2006.01) |
| ***H01F 27/28*** | (2006.01) |
| ***H01F 27/12*** | (2006.01) |
| ***H01F 27/34*** | (2006.01) |

(52) U.S. Cl.

CPC ..... *H01F 27/29* (2013.01); *E02B 3/00* (2013.01); *H01F 27/02* (2013.01); *H01F 27/12* (2013.01); *H01F 27/2823* (2013.01); *H01F 27/343* (2013.01)

(58) Field of Classification Search

CPC ..... H01F 27/343; H01F 27/16; H01F 27/341

USPC ..... 336/5, 57, 60

See application file for complete search history.

(56) References Cited

U.S. PATENT DOCUMENTS

| | | | |
|---|---|---|---|
| 4,138,699 | A | 2/1979 | Ura et al. |
| 5,131,464 | A | 7/1992 | Lenhart et al. |
| 6,867,364 | B2 | 3/2005 | Hafskjold et al. |
| 7,516,795 | B2 | 4/2009 | Lopes Euphemio et al. |
| 8,439,080 | B2 | 5/2013 | Uusipaikka |
| 8,456,116 | B2 | 6/2013 | Burdick |
| 8,549,924 | B2 | 10/2013 | Virtanen et al. |
| 9,308,618 | B2 | 4/2016 | Benvegnu |
| 2008/0144442 | A1 | 6/2008 | Combee et al. |
| 2010/0089126 | A1 | 4/2010 | Sweeney |
| 2011/0000677 | A1 | 1/2011 | Overfield |
| 2011/0316659 | A1 | 12/2011 | Puchianu et al. |
| 2012/0001482 | A1 | 1/2012 | Burdick |
| 2013/0220625 | A1 | 8/2013 | Billington et al. |
| 2014/0147243 | A1 | 5/2014 | Torkildsen et al. |
| 2016/0181964 | A1 | 6/2016 | Nojima |

FOREIGN PATENT DOCUMENTS

| | | | |
|---|---|---|---|
| WO | 2008055515 | A1 | 5/2008 |

*Primary Examiner* — Elvin G Enad
*Assistant Examiner* — Ronald Hinson
(74) *Attorney, Agent, or Firm* — Fletcher Yoder P.C.

(57) ABSTRACT

A seawater-based high resistance grounding device for a subsea transformer includes an insulated pipe mounted to the outside of the transformer so as to be exposed to seawater. The insulated pipe has two or more cylindrical metallic electrodes electrically connected to ground and to the neutral node of the secondary transformer windings. The volume of seawater within the pipe and between the electrodes provides one or more high resistance ground paths for protection of the transformer.

13 Claims, 5 Drawing Sheets

SUBSEA TRANSFORMER WITH SEAWATER HIGH RESISTANCE GROUND

TECHNICAL FIELD

The present disclosure relates to subsea power transformers. More particularly, the present disclosure relates to three-phase subsea power transformers having high resistance grounding systems.

BACKGROUND

In the subsea oil and gas industry, it is often desirable to perform certain fluid processing activities on the sea floor. Examples include fluid pumps (both single phase and multiphase) and compressors (both gas compressors and "wet gas" compressors). The subsea pumps and compressors are commonly driven with electric motors, which are supplied by three-phase electrical power via one or more umbilical cables from a surface facility. Especially in cases where the umbilical cable is relatively long, it is desirable to transmit the electrical power at higher voltages through the umbilical cable and use a subsea transformer to step-down a voltage suitable for use by the subsea electric motors.

High resistance grounding (HRG) is a principle that is well known and has been used in medium voltage distribution transformer systems. The purpose of the HRG is twofold: (1) to clamp the otherwise isolated neutral point of the transformer to ground; and (2) limit possible ground fault current to a low and well defined level. In normal operation, the vector sum of the capacitive currents between the three live symmetrical phases will be zero, and no current will flow in the HRG from the transformer neutral point. With an earth fault present in one of the phases, the two healthy phases will have the correct line voltage values relative to each other both in magnitude and in phase, although they will be shifted in voltage.

In land-based medium voltage distribution systems, an HRG system is commonly arranged as an air-cooled device contained in either a separate cabinet or as free standing resistors mounted on insulators in an open arrangement in a high voltage room. In some cases, liquid neutral resistors are used in topside systems. In subsea installations, the HRG unit has been provided by a solid resistive element located in a separate compartment from the main transformer windings. FIGS. 6 and 7 are schematic diagrams illustrating aspects of subsea transformers with known HRG protection techniques.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a subsea transformer protected by high resistance grounding is described. The transformer includes: a primary set of coil windings; a secondary set of coil winding; a subsea transformer tank defined by a tank wall and housing the primary and secondary sets of coil windings; and a seawater-based high resistance grounding device positioned outside of the transformer tank. The seawater-based high resistance grounding device includes: a first electrode electrically connected to a neutral node of the secondary set of coil windings; a second electrode electrically connected to a ground; and a volume of seawater which provides a high electrical resistance electrical path between the first and second electrodes.

The seawater-based high resistance grounding device can also include an insulated pipe having a first end where the first electrode is positioned, a second end where the second electrode is positioned, and an opening allowing seawater to enter the insulated pipe. The insulated pipe between the first and second electrodes defines the volume of seawater. According to some embodiments, the insulated pipe is open on both first and second ends allowing seawater to flow through the insulated pipe.

According to some other embodiments, the seawater-based high resistance grounding device also includes an insulated pipe having a first end, a second end, an intermediate location along the insulated pipe, and an opening allowing seawater to enter the insulated pipe, the first electrode being positioned at the intermediate location, with the second electrode being positioned at the first end; and a third electrode electrically connected to the ground and positioned at the second end. The insulated pipe between the first and second electrodes defines the volume of seawater. The insulated pipe between the first and third electrodes defines a second volume of seawater which provides a high electrical resistance path between the first and third electrodes and is electrically in parallel to the volume of seawater. The insulated pipe can be open on both first and second ends to allow seawater to flow through the insulated pipe. The insulated pipe can be mounted to the transformer tank vertically such that heated seawater can exit through an upper end and cool seawater can enter through a lower end.

According to some embodiments, the first and second electrodes are electrically connected to the neutral node and the ground, respectively, via low-resistance paths. The first and second electrodes can be metallic, and the seawater-based high resistance grounding device can have a resistance of at least 1000 ohms.

According to some embodiments, transformer oil positioned is within the tank that bathes the primary and secondary sets of coil windings. The tank wall can be suitable for long-term deployment in a subsea environment wherein the outer surface of the tank wall is exposed to seawater and the inner surface of the tank wall is exposed to the transformer oil.

According to some embodiments, the transformer is configured to supply power to one or more subsea motors used for processing hydrocarbon bearing fluids produced from a subterranean rock formation. The subsea motor(s) can be configured for driving one or more subsea pumps, compressors or separators.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

The particulars shown herein are by way of example, and for purposes of illustrative discussion of the embodiments of the subject disclosure only, and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Further, like reference numbers and designations in the various drawings indicate like elements.

According to some embodiments a seawater-based high resistance ground device is described. Using seawater as a resistive medium has a number of advantages over solid-based high resistance ground techniques that have been used in subsea applications. Cooling is much more effective when using seawater as the resistive medium since seawater is readily available in subsea applications and the cooling is direct. The design can be made extremely simple, without the need for additional sealed compartments and/or insulating oil. The seawater-based HRG device can also be very reliable, which is often an important consideration in subsea applications where intervention costs are relatively high. Instead of relying on active heat wires, which can fail over time, a seawater based HRG device has virtually limitless access to conductive medium when deployed in a subsea system.

Figure 1:
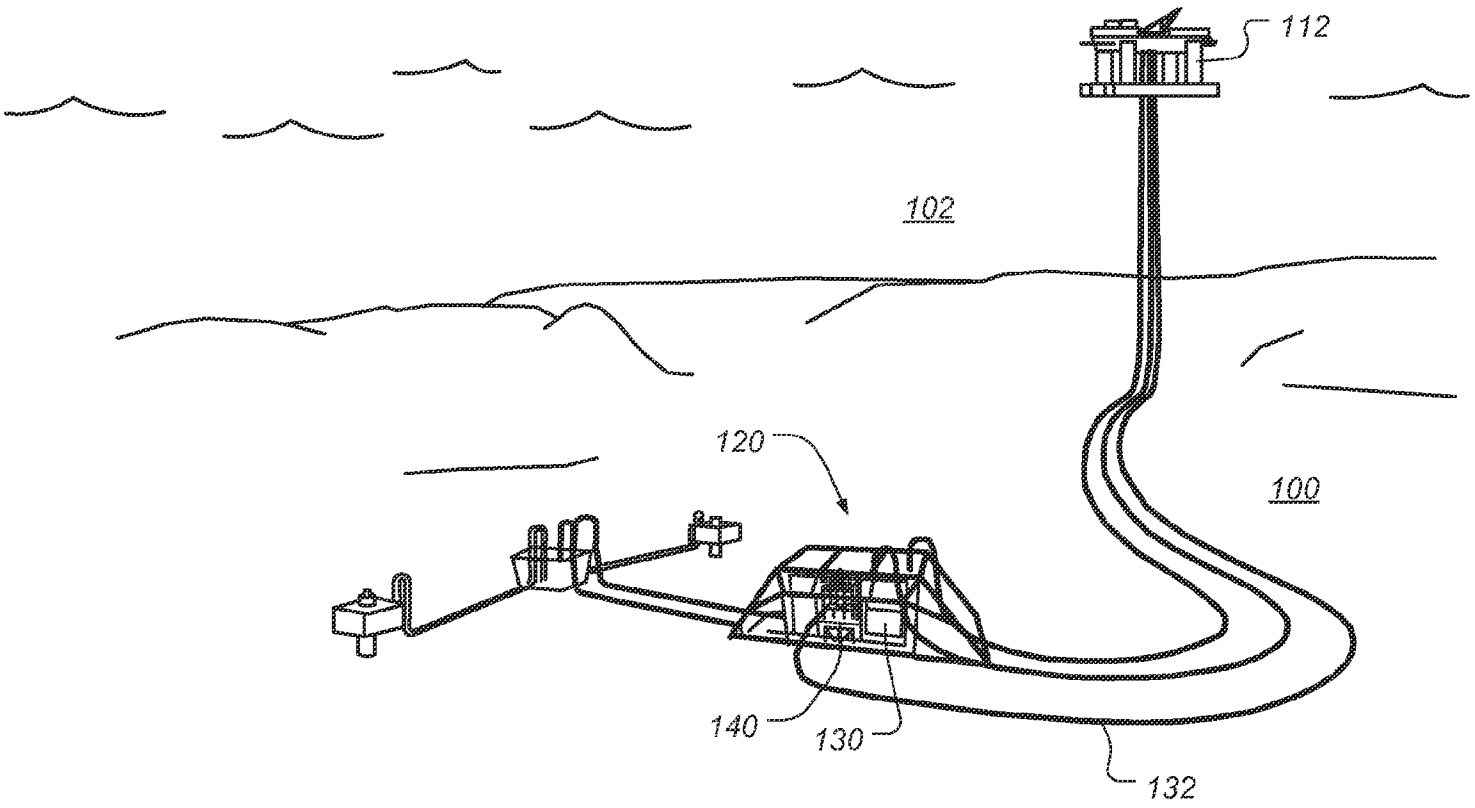
FIG. 1 is a diagram illustrating a subsea environment in which a subsea transformer using a seawater-based HRG device is deployed, according to some embodiments.

FIG. 1 is a diagram illustrating a subsea environment in which a subsea transformer using a seawater-based HRG device is deployed, according to some embodiments. On sea floor 100 a station 120 is shown which is downstream of several wellheads being used, for example, to produce hydrocarbon-bearing fluid from a subterranean rock formation. Station 120 includes a subsea pump module 130, which has a pump (or compressor) that is driven by an electric motor. The station 120 is connected to one or more umbilical cables, such as umbilical 132. The umbilicals in this case are being run from a platform 112 through seawater 102, along sea floor 100 and to station 120. In other cases, the umbilicals may be run from some other surface facility such as a floating production, storage and offloading unit (FPSO), or a shore-based facility. In many cases to reduce energy losses, it is desirable to transmit energy through the umbilicals at higher voltages than is used by the electric motor in pump module 130. Station 120 thus also includes a step-down transformer 140, which converts the higher-voltage three-phase power being transmitted over the umbilical 132 to lower-voltage three-phase power for use by pump module 130. In addition to pump module 130 and transformer 140, the station 120 can include various other types of subsea equipment, including other pumps and/or compressors. The umbilical 132 can also be used to supply barrier and other fluids, and control and data lines for use with the subsea equipment in station 120. Note that although transformer 140 is referred to herein as a three-phase step-down transformer, the techniques described herein are equally applicable to other types of subsea transformers such as having other numbers of phases, and being of other types (e.g. step-up transformer).

Figure 2:
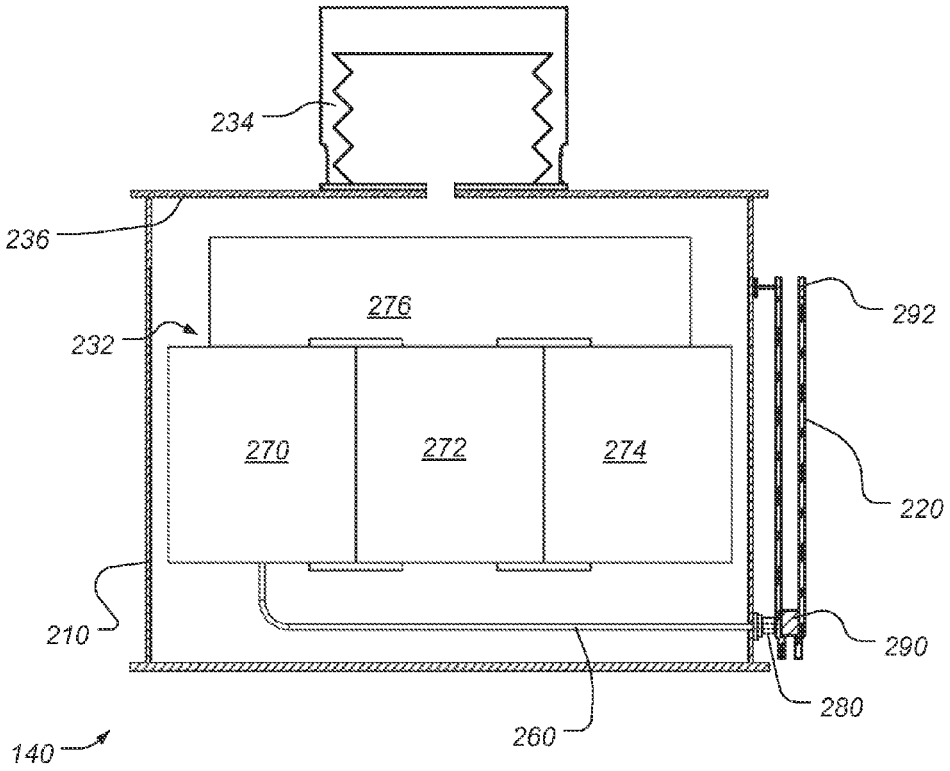
FIG. 2 is a cut-away diagram showing various components of a subsea transformer employing a seawater-based HRG device, according to some embodiments.

FIG. 2 is a cut-away diagram showing various components of a subsea transformer employing a seawater-based HRG device, according to some embodiments. Subsea transformer 140 includes a tank wall 210 onto which the seawater-based HRG device 220 is mounted. Inside the transformer tank is the active portion 232 of the transformer, which includes the primary and secondary windings 270, 272 and 274 for the three phases as well as the transformer core 276. Transformer tank compensator 234 is used to compensate the transformer tank volume for pressure changes due to temperature fluctuations. The active portion 232 is sealed in the transformer tank by the tank wall 210 and the tank lid 236. According to some embodiments, subsea transformer 140 is a two-tank design using double barriers such as described in further detail in co-pending U.S. patent application Ser. No. 14/631,649, filed on Feb. 25, 2015, entitled "Fault Tolerant Subsea Transformer", which is herein incorporated by reference in its entirety.

Also visible in FIG. 2 is neutral conductor 260 that is directly connected to the neutral node of the secondary windings for the three phases (i.e. which are arranged in a "wye" configuration). Neutral conductor 260 exits tank wall 210 via bushing 280 and makes connection to electrode 290 of seawater-based HRG device 220. On the upper end of HRG device 220 is an upper electrode 292 that is electrically connected to ground, which in this case is the tank wall 210. Note that according to some embodiments, the transformer tank walls are grounded, and are grounded through connection to an umbilical termination head (not shown), and up to the vessel or surface facility, such as platform 112 shown in FIG. 1.

Figure 3:
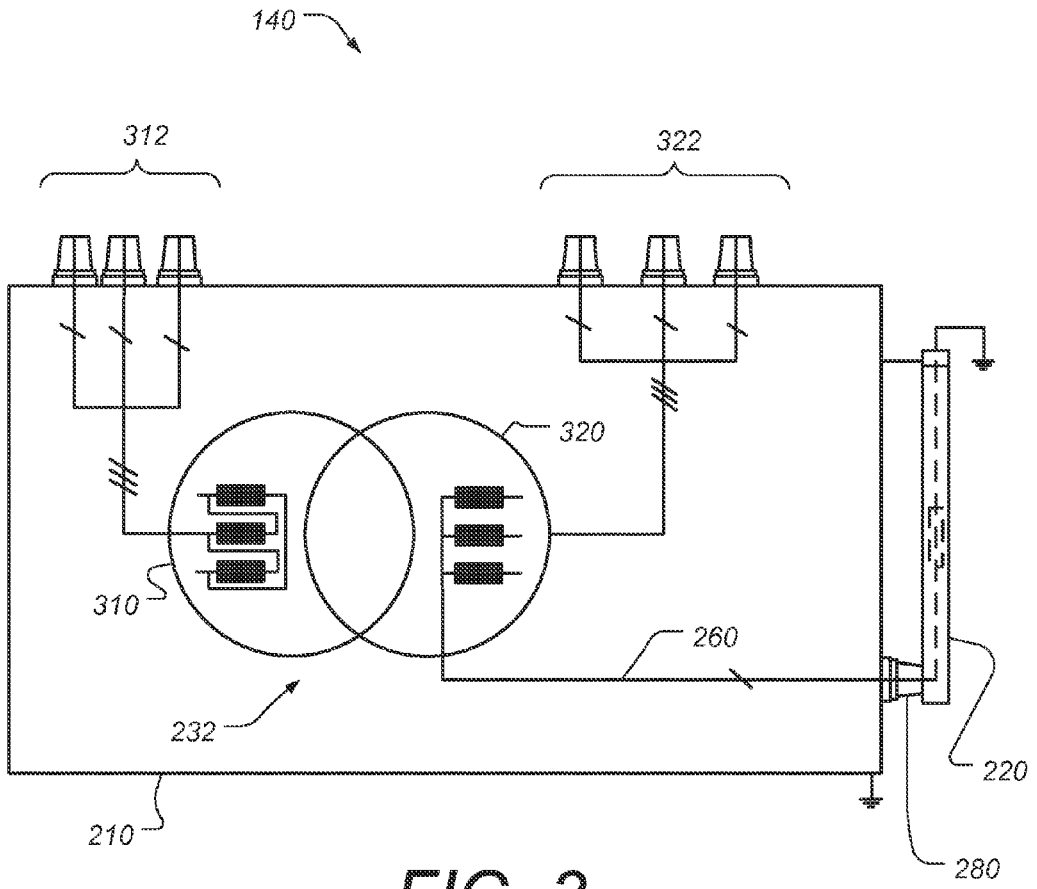
FIG. 3 is a schematic diagram showing further aspects of a subsea transformer employing a seawater-based HRG device, according to some embodiments.

FIG. 3 is a schematic diagram showing further aspects of a subsea transformer employing a seawater-based HRG device, according to some embodiments. In this diagram it can be seen that active portion 232 of subsea transformer 140 is arranged in a "delta" structure for the primary windings 310 and a "wye" structure for secondary windings 320. Also visible are primary phase bushings 312 and secondary phase bushings 322. The neutral conductor 260 is shown running from the neutral node of the secondary windings 320 through bushing 280 to the HRG device 220.

Figure 4:
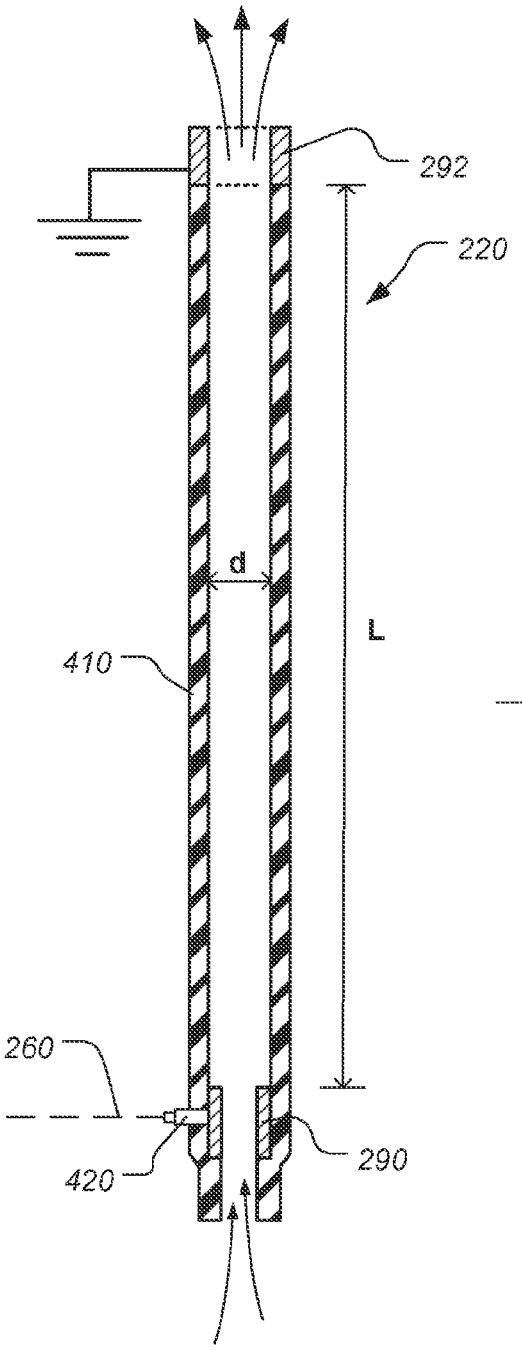
FIG. 4 is a cross-section diagram showing aspects of a seawater-based HRG device for use with a subsea transformer, according to some embodiments.

FIG. 4 is a cross-section diagram showing aspects of a seawater-based HRG device for use with a subsea transformer, according to some embodiments. The device 220 in this example includes an insulated pipe 410 that has a length L and internal diameter d. According to some embodiments, pipe 410 can be made of a plastic or rubber material suitable for long-term subsea deployment, such as material used in subsea cable housings. Inside the lower end of pipe 410 is a lower metallic cylindrical electrode 290 that is connected to neutral conductor 260 via a bushing 420. Neutral conductor 260 runs to the neutral point of the secondary windings of the transformer. A second, upper metallic cylindrical electrode 292 is positioned inside the upper end of pipe 410. Electrode 292 is grounded, such as to a metallic tank wall of the transformer. In the example shown in FIG. 4 both ends of the pipe 410 are open to allow seawater to enter pipe 410. In some cases one or the other of the electrodes 290 or 292 can be solid instead of cylindrical so long as there is an opening in the pipe 410 to allow entry of seawater. In cases where both ends of pipe 410 are open, however, an added benefit of seawater flow is provided wherein seawater that is heated can escape upwards and be replaced by cool seawater from the bottom.

The resistivity of sea water at 20° C. and that of a conventional copper conductor is as follows:

$\rho_{sw}$=0.25 Ω·m Seawater with 35 o/oo salinity; and $\rho_{cu}$=0.01754·$10^{-6}$ Ω·m Copper conductor.

Thus, a seawater-based HRG device can be provided with a relatively minor volume of seawater. For example, where L=1.5 m and d=11 mm, the resistance of the volume of seawater within pipe 410 between the electrodes 290 and 292 can be calculated as follows:

$$0.25\Omega\cdot m\frac{1.5m}{\frac{\pi}{4}(0.011m)^2}=3946\Omega.$$

Figure 5:
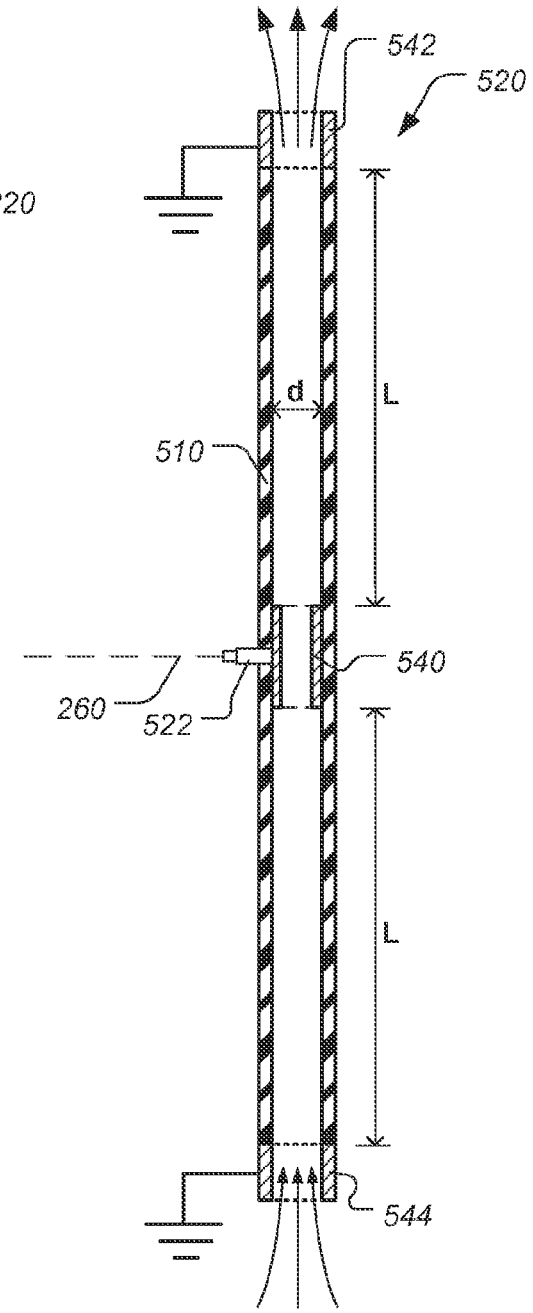
FIG. 5 is a cross-section diagram showing aspects of a seawater-based HRG device for use with a subsea transformer, according to some other embodiments.

FIG. 5 is a cross-section diagram showing aspects of a seawater-based HRG device for use with a subsea transformer, according to some other embodiments. The device 520 includes effectively two seawater resistance paths in parallel. According to some embodiments, a device such as device 520 is used in a similar or identical manner with a subsea transformer as is device 220 as described elsewhere herein. Insulated pipe 510 has a length 2×L and internal diameter d. As in device 220 shown in FIG. 4, pipe 510 can be made of a plastic or rubber material suitable for long-term subsea deployment, such as material used in subsea cable housings. Inside pipe 510 is a central metallic cylindrical electrode 540 that is connected to neutral conductor 260 via a bushing 522. Neutral conductor 260 runs to the neutral point of the secondary windings of the transformer. Two additional metallic cylindrical electrodes 542 and 544 are positioned inside the upper and lower ends, respectively, of pipe 510. Electrodes 542 and 544 are grounded, such as to a metallic tank wall of the transformer. In the example shown in FIG. 5, both ends of the pipe 510 are open to allow seawater to enter and exit pipe 510, such that seawater flow is provided wherein seawater that is heated can escape upwards and be replaced by cool seawater from the bottom of pipe 510. In one example, where L=1.2 m and d=7 mm, the effective resistance of the seawater-based HRG device 520 can be calculated as follows:

$$0.5\cdot 0.25\Omega\cdot m\frac{1.2m}{\frac{\pi}{4}(0.007m)^2}=3898\Omega.$$

Figure 6:
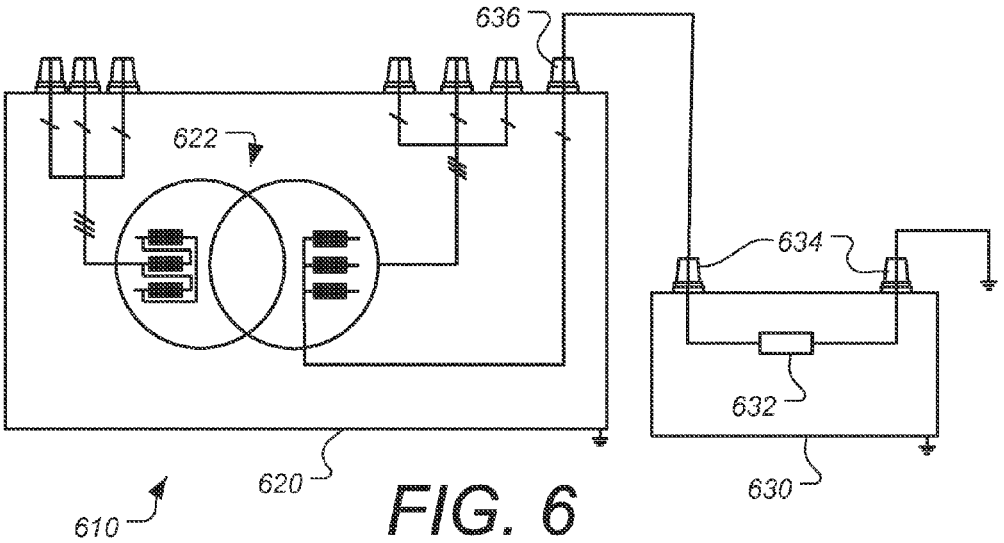
FIG. 6 (prior art)
FIGS. 6 and 7 are schematic diagrams illustrating aspects of subsea transformers with known HRG protection techniques.
Figure 7:
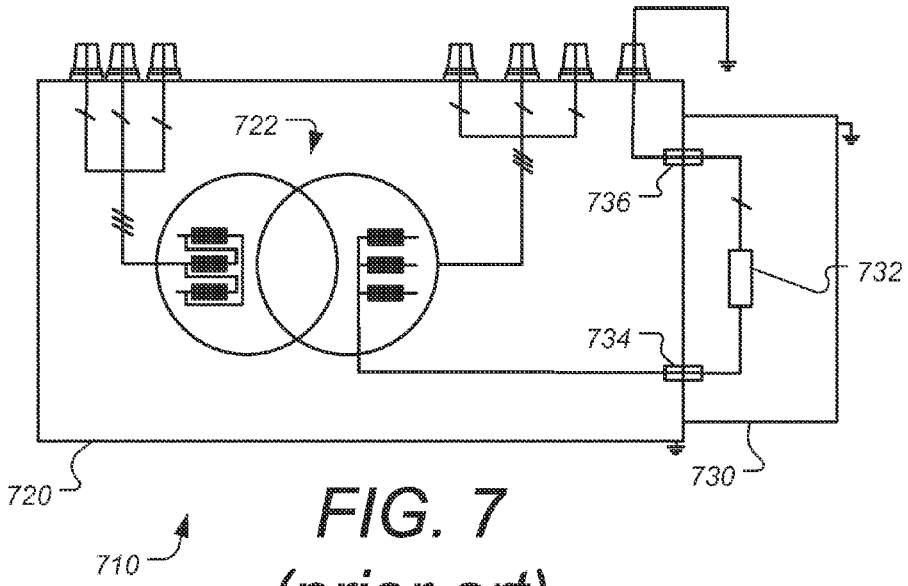
FIG. 7 (prior art)

FIGS. 6 and 7 are schematic diagrams illustrating aspects of subsea transformers with known HRG protection techniques. In FIG. 6, subsea transformer 610 includes a transformer tank 620 that houses active transformer components 622. The neutral node of the transformer is connected to separate high resistance ground unit 630 that includes high resistance element(s) 632. The high resistance grounding unit 632 is connected to the neutral node and ground via conductors passing through bushings 634 and 636. The layout of subsea transformer 710 FIG. 7 is similar to that of transformer 610 in FIG. 6, except that the high resistance ground unit 730 is directly mounted to the outside of transformer tank 720. The high resistance element(s) 732 are electrically connected to ground and to the neutral node of the active transformer components 722 via bushings 734 and 736.

While the subject disclosure is described through the above embodiments, it will be understood by those of ordinary skill in the art that modification to and variation of the illustrated embodiments may be made without departing from the inventive concepts herein disclosed. Moreover, while some embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A subsea transformer protected by high resistance grounding comprising:
- a primary set of coil windings;
- a secondary set of coil winding;
- a subsea transformer tank defined by a tank wall and housing said primary and secondary sets of coil windings; and
- a seawater-based high resistance grounding device positioned outside of said transformer tank, comprising:
  - a first electrode electrically connected to a neutral node of said secondary set of coil windings;
  - a second electrode electrically connected to a ground; and
  - a volume of seawater which provides an electrical resistance electrical path between said first and second electrodes.

2. The subsea transformer according to claim 1 wherein said seawater-based resistance grounding device further comprises an insulated pipe having a first end where said first electrode is positioned, a second end where said second electrode is positioned, and an opening allowing seawater to enter said insulated pipe, said insulated pipe between the first and second electrodes defining said volume of seawater.

3. The subsea transformer according to claim 1 wherein said insulated pipe is open on both first and second ends allowing seawater to flow through said insulated pipe.

4. The subsea transformer according to claim 1 wherein said seawater-based high resistance grounding device further comprises:
- an insulated pipe having a first end, a second end, an intermediate location along said insulated pipe, and an opening allowing seawater to enter said insulated pipe, said first electrode being positioned at said intermediate location, said second electrode being positioned at said first end; and
- a third electrode electrically connected to said ground and positioned at said second end, said insulated pipe between said first and second electrodes defining said volume of seawater and between said first and third electrodes defining a second volume of seawater which provides an electrical resistance path between said first and third electrodes and is electrically in parallel to said volume of seawater.

5. The subsea transformer according to claim 4 wherein said insulated pipe is open on both first and second ends allowing seawater to flow through said insulated pipe.

6. The subsea transformer according to claim 5 wherein said insulated pipe is mounted to said transformer tank vertically such that heated seawater can exit through an upper end and cool seawater can enter through a lower end.

7. The subsea transformer according to claim 1 wherein said first and second electrodes are electrically connected to said neutral node and said ground, respectively, via low-resistance paths.

8. The subsea transformer according to claim 1 wherein the transformer is a step-down or a step-up transformer.

9. The subsea transformer according to claim 1 wherein said seawater-based high resistance grounding device has a resistance of at least 1000 ohms.

10. The subsea transformer according to claim 1 wherein said ground is said tank wall.

11. The subsea transformer according to claim 1 further comprising a transformer oil positioned within said tank that bathes said primary and secondary sets of coil windings, wherein said tank wall is suitable for deployment in a subsea environment wherein an outer surface of the tank wall is exposed to seawater and an inner surface of the tank wall is exposed to said transformer oil.

12. The subsea transformer according to claim 1 wherein said transformer is configured to supply power to one or more subsea components used for processing hydrocarbon fluids produced from a subterranean rock formation.

13. The subsea transformer according to claim 12 wherein said one or more subsea components are motors configured for driving one or more subsea pumps, compressors or separators.

* * * * *